US007261677B2

(12) United States Patent
Åhman

(10) Patent No.: US 7,261,677 B2
(45) Date of Patent: Aug. 28, 2007

(54) WEIGHT EQUIPMENT FOR SITUPS AND BACK EXTENSIONS

(76) Inventor: Johan Åhman, Palstigen 2, 40344 Umeå (SE)

( * ) Notice: Subject to any disclaimer, the term of this patent is extended or adjusted under 35 U.S.C. 154(b) by 51 days.

(21) Appl. No.: 10/495,856

(22) PCT Filed: Nov. 15, 2002

(86) PCT No.: PCT/SE02/02062

§ 371 (c)(1),
(2), (4) Date: Aug. 11, 2004

(87) PCT Pub. No.: WO03/041810

PCT Pub. Date: May 22, 2003

(65) Prior Publication Data

US 2005/0014614 A1 Jan. 20, 2005

(30) Foreign Application Priority Data

Nov. 16, 2001 (SE) ..... 0103815

(51) Int. Cl.
*A63B 21/065* (2006.01)
*A63B 23/02* (2006.01)

(52) U.S. Cl. ..... 482/105; 482/140; 482/93

(58) Field of Classification Search ..... 482/105–109, 482/140, 92–96, 74; 280/756, 801, 801.1; 21/65; D21/683; 2/463
See application file for complete search history.

(56) References Cited

U.S. PATENT DOCUMENTS 1,154,689 A * 9/1915 Bradley ..... 2/2.5
1,250,197 A * 12/1917 Louppe ..... 2/2.5
1,279,571 A * 9/1918 Moloney ..... 2/2.5
3,370,850 A 2/1968 Moore
4,213,605 A * 7/1980 McPeak ..... 482/105
4,268,917 A * 5/1981 Massey ..... 2/102
4,602,387 A * 7/1986 Zakrzewski ..... 2/102
4,658,442 A * 4/1987 Tomlinson et al. ..... 2/94
D293,354 S * 12/1987 Nelson ..... D21/683
D299,373 S * 1/1989 Parker et al. ..... D21/682
4,863,158 A 9/1989 Tassone
4,898,380 A * 2/1990 Kobrin ..... 482/93
4,986,536 A * 1/1991 Zane ..... 482/106
5,122,107 A 6/1992 Gardner
5,137,502 A 8/1992 Anastasi
5,167,600 A * 12/1992 Baird ..... 482/105
5,211,615 A * 5/1993 Sides ..... 482/105
5,267,931 A 12/1993 Faetini
5,299,999 A * 4/1994 Brine ..... 482/105
5,472,398 A * 12/1995 Silverman ..... 482/105
5,692,996 A 12/1997 Widerman
5,709,634 A 1/1998 Pointer
5,716,305 A 2/1998 Selsam
5,792,035 A 8/1998 Ward et al.
5,957,818 A * 9/1999 Betournay ..... 482/105
6,081,924 A * 7/2000 Ott ..... 2/102
6,126,581 A 10/2000 Hartsel
6,224,517 B1 5/2001 Dereszynski
6,554,752 B2 * 4/2003 Cook ..... 482/105
6,669,608 B1 * 12/2003 Winston ..... 482/105
6,675,391 B2 * 1/2004 Morrison ..... 2/102
7,124,675 B1 * 10/2006 Sand ..... 89/36.07

* cited by examiner

*Primary Examiner*—Cary E. O'Connor
*Assistant Examiner*—Victor K. Hwang
(74) *Attorney, Agent, or Firm*—Ladas & Parry LLP

(57) ABSTRACT

Weight equipment for doing crunches, situps, and back extensions. A specially devised weight plate fits the upper chest and front shoulders, and has two handles placed at each hand's natural path (without necessitating the twisting of the wrists as they are moved to the upper part of chest. The equipment is intended to come in a collection of different weights in a weight rack that can be used at community gyms and fitness centers.

14 Claims, 8 Drawing Sheets

[a]

[b]

WEIGHT EQUIPMENT FOR SITUPS AND BACK EXTENSIONS

BACKGROUND OF THE INVENTION—TECHNICAL FIELD

1. Technical field

Figure 1:
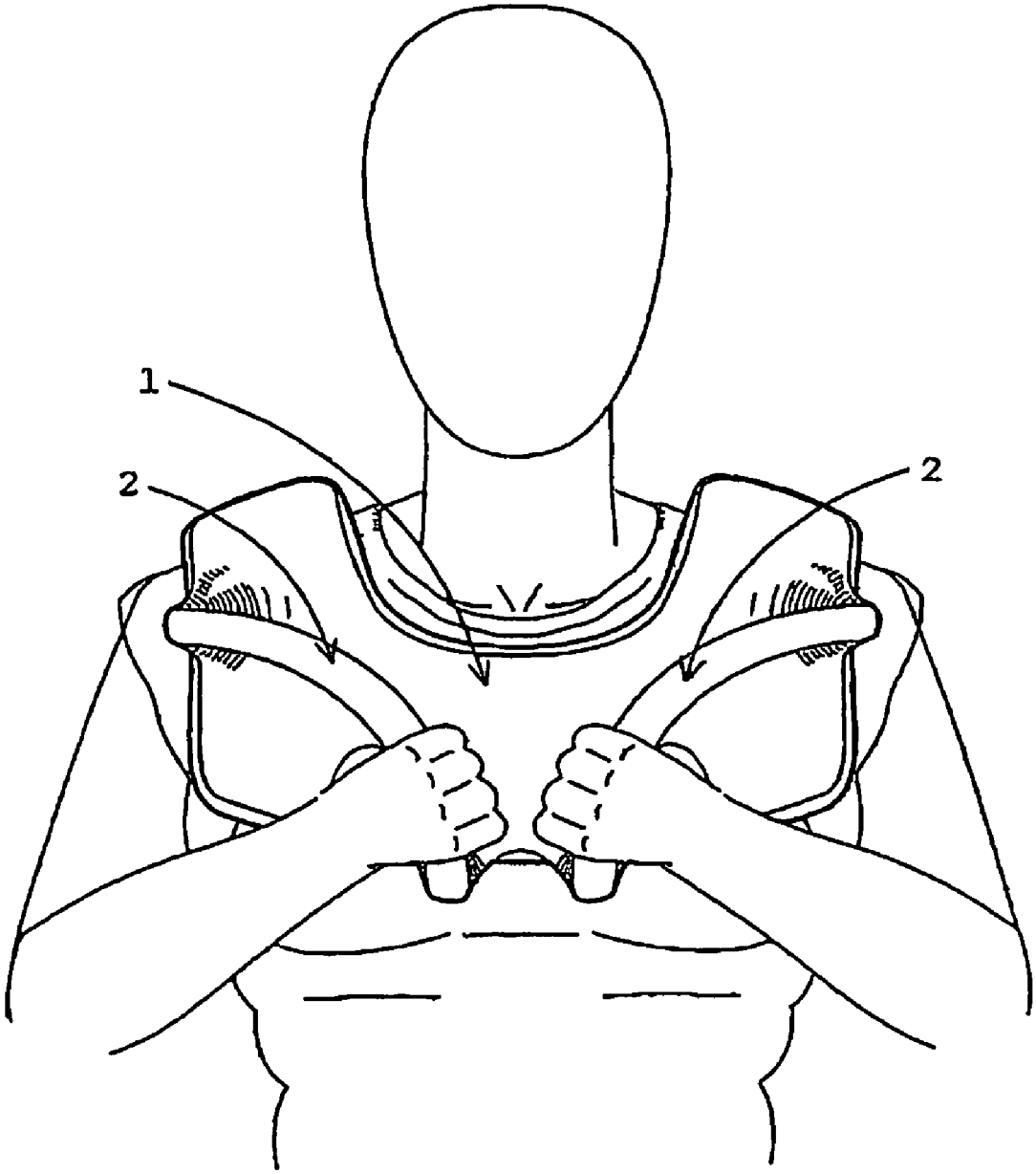

The invention lies in the field of strength training (of a human body) by subjecting muscles, joints, and 1*e* skeleton to resistance due to gravity caused by weights. More specifically, the training concerns abdominal training with the exercise forms of situps or crunch, and back training with the exercise form of back extensions (also called hyper extensions). The invention is a compact equipment of the type free weight (in contrast to machine).

2. Definitions

The following definitions are provided for reference. Crunch is an exercise performed by using the abdominal muscles to curl up and pull the chest region towards the hips. Essentially only the abdominal muscles are being used, and the hips and thighs should not move during the exercise. The exercise is normally performed from a starting position lying with the back against the floor (or other horizontal support) with thighs in 90 degrees relative to the support and with the lower legs loosely resting (not locked) on a bench or similar. When doing situps not only are the abdominal muscles volitionally used, but also the hip flexors and the frontal thigh muscles.

Situps are done from a starting position lying on the back with the shoulders level with, or lower than, the hips. The legs are bent and usually with the lower legs or the feet locked under some restraint. The exercise is then performed by lifting as well as curling the upper body towards the knees. Both crunch and situps may be performed with twisted upper body, and then not only the straight muscle of the belly (rectus abdominis) but also to a great extent the waist muscles (obliques), are being used. Back extension is an exercise that is performed using a roman chair in which the person can lock his or her legs in a horizontal position, with the belly and the face facing the floor. The exercise is performed by bending the upper body at the hips, thereby lowering the head and the shoulders until the upper body hangs relaxed approximately vertically. And thereafter the upper body is raised, and the spine is extended with a curling movement, whereby the person returns to horizontal position. The lower back (erector spinae) predominantly used in the exercise, but also to some extent the muscles between the shoulder blades, the buttocks, and the back thighs.

BACKGROUND OF THE INVENTION—TECHNICAL PROBLEM SOLVED BY THE INVENTION

Introduction

When doing resistance training in general (independent of training type) it is essential to choose an appropriate level of resistance (right size of weight plate or similar). The appropriate level of resistance depends on factors such as the person's strength level and current training phase. An experienced person repeatedly makes active choices of the level of resistance (at each training occasion, at each training set, and sometimes in the middle of a set). For a beginner it is enough with his or her own body weight as resistance, when doing situps and back extension. But for a person who has built a base strength, and wants do develop further, it is important also in the case of situps and back extensions to be able to increase the resistance (this is valid also for crunch even though this exercise requires considerably less resistance). This is ordinarily done by holding a weight plate (actually used for weight bars) of suitable weight, or sometimes a dumbbell, against the chest.

Unsuitable Placement

A problem with this procedure is that the weight of the plate cannot be used effectively. A circular weight plate of more than about 5 kg has quite a large diameter and must therefore be held in a rather low position on the chest in order for it not to hit against the chin or throat. Since the plate ends up low positioned on the chest, close to the region of the belly muscles, the weight will not be used effectively. A solution to this is to hold the weight plate behind the neck, but this is a more or less uncomfortable placement, and thus not a good solution.

Bad Grip

Another problem is that a circular weight plate located high up on the chest is difficult to grip. A relatively good grip, and a relatively comfortable arm and wrist placement, may be obtained by placing the arms crossed over the plate. This is due to the following two reasons. First, in order to hold the hands high up but close to the chest without uncomfortably twisting the wrists, one has to put the left hand on the right chest and vice versa. Second, if the arms are crossed the hands can take hold of the edge of the plate in its radial direction, resulting in a firm grip. Even if one were to obtain a good grip and comfortable arm and wrist placement, this is still not an altogether comfortable posture, especially if the weights are big and heavy.

Not Easy Accessible

The reason why people in gyms are selecting weight plates in spite of them not being specifically devised for situps or back extension, is that they are easy accessible; there are always plates of suitable weight available, and it is quick to pick up a plate and start the exercise right away (without any adjustments of equipment). There is however weight equipments specifically intended for situps and back extensions (described below). Most of these are however the kind of equipment that cannot be made easily accessible. And the ones that can be made easily accessible are not properly devised (which will be described below).

BACKGROUND OF THE INVENTION—PRIOR ART

This section describes existing equipment that belongs to the same field as the present invention, i.e. compact equipment, of the type free weights (in contrast to machines), for crunch, situps, and back extensions.

Solution 1

U.S. Pat. No. 5,792,035 describes an equipment for abdominal training with weights. The equipment consists of a frame that, while in use, rests on the shoulders and against the back of the head. Weight plates may be stacked on rods at each side of the head, and in this way the weight may be adjusted.

Solution 2

U.S. Pat. No. 5,709,634 shows an equipment to be held behind the head. The weight can be adjusted either by filling a cavity with water, sand, etc., or by stacking weight plates on a shaft placed in the middle of the equipment.

Solution 3

The equipment described by U.S. Pat. No. 4,863,158 is a weight bar on which weights may be fastened at each end. The bar has an inward bend in the middle to fit the neck, and is equipped with two handles extending from the bar on each side of the neck down in front of the chest.

The above three patents describe equipment that are difficult to make easily accessible in a collection of different weights (because they are relatively complex and therefore expensive). The weight of the equipment in it self must therefore often be adjusted (for example by removing or adding weight plates), which is time consuming.

Solution 4

A kind of weight plate to be held by hand, is described in U.S. Pat. No. 5,692,996. It is intended for fitness exercises done with weights, and has two handles making it easier to grip than an ordinary weight. It also has a curved form that is advantageous when the weight is kept dose to the body. The equipment could also be used when doing abdominal training or back extensions, instead of an ordinary weight plate. The equipment is to some extent based on the form of the weight plate described in U.S. Pat. No. 5,137,502 The handles placement and the circular form however, do not make it particularly suitable for situps or back extensions.

Solution 5

There are a number of abdominal training equipments intended to be held behind the neck. The purpose for most of these is to unload the neck and throat musculature when doing situps, but the equipments by themselves have some weight, which means that they to some extent may function similar to the present invention. One of these, described in U.S. Pat. No. 5,267,931, is an oblong plate with handles at each end. The position of the handles does however not give a comfortable arm and wrist placement when doing abdominal training and back extensions using weights. Another patent that also is relevant to the invention is U.S. Pat. No. 6,126,581. It describes a bar with a padded arch fitting the neck. The bar has a form (a slight V-form) with the purpose to make it easy to rest the arms behind the bar in a locked and stable position. Since the bar is relatively voluminous and expensive (compared to a weight plate), the equipment cannot be made easy accessible in a collection of different weights. In addition the equipment allows only certain kinds of situps and back extensions.

Solution 6

Another type of device that also is relevant for this invention, is based on the principle of fastening weights on a harness, a waistcoat, or similar equipment. However as far as we have seen, there are no sufficiently simple such equipment, because all are based on the equipment's weight being adjusted by removing, respectively adding, loose weights (on the waistcoat, harness, etc.). The equipment described in U.S. Pat. No. 5,122,107 is a harness with a weight (in the form of a container that can be filled with sand etc.) that is fastened on the chest. The waistcoat in U.S. Pat. No. 5,167,600 has a vertically slidable cross bar with a rod on which weight plates may be fastened. This waistcoat may be used for example when doing back extensions. An equipment somewhat reminding about these two, found in U.S. Pat. No. 3,370,850, may be described as a weight bar to be suspended on the shoulders. In principle, a variant of this equipment could be used when doing situps, even if this originally not was the purpose.

Solution 7

Yet another equipment that may be said to fall within the same category as the present invention, can be found in U.S. Pat. No. 5,716,305. This equipment is not intended for situps or back extensions, but a scaled down version (lighter and smaller) could in principle be used for that purpose. But the handles position in addition to the equipment's form, are not particularly suitable for back extensions or situps.

OBJECTS OF THE INVENTION

Object

The weight equipment according to present invention should be: A—compact and simple in its design, B—easy to pick up and use as is (without adjustments). C—simple to keep, in a number of different weights, in a rack. These advantages are shared with an ordinary weight plate. The present invention should however, in contrast to a weight plate, be possible to use with D—anatomically restful arm and wrist posture, E—be able to be placed high on the chest yet comfortable and stable.

DRAWINGS—BRIEF DESCRIPTION

FIG. 1 Shows the equipment's placement, and its main components.

Figure 2:
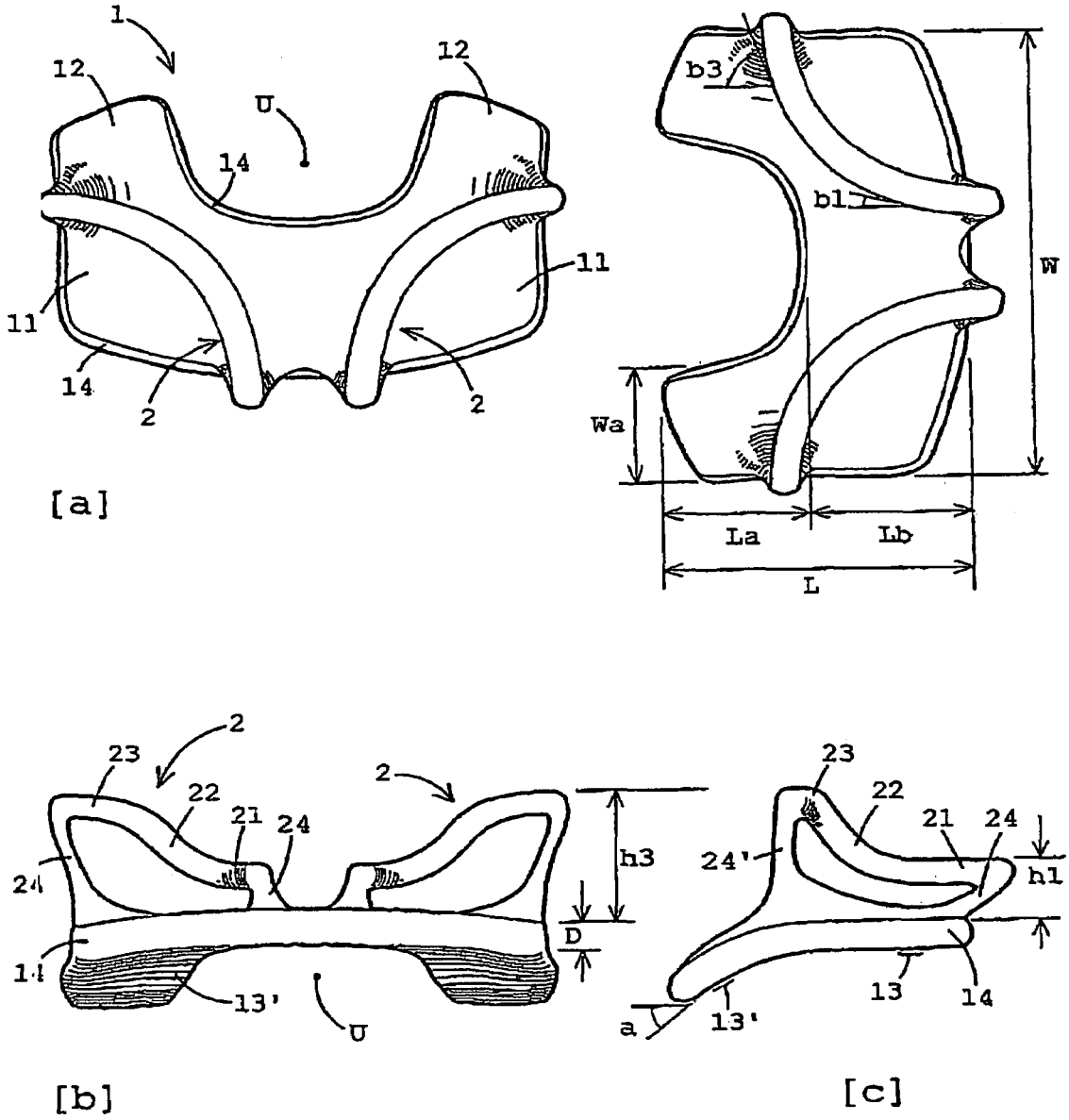

FIG. 2 Embodiment 1: definition of the equipment's components and their measures.

Figure 3:
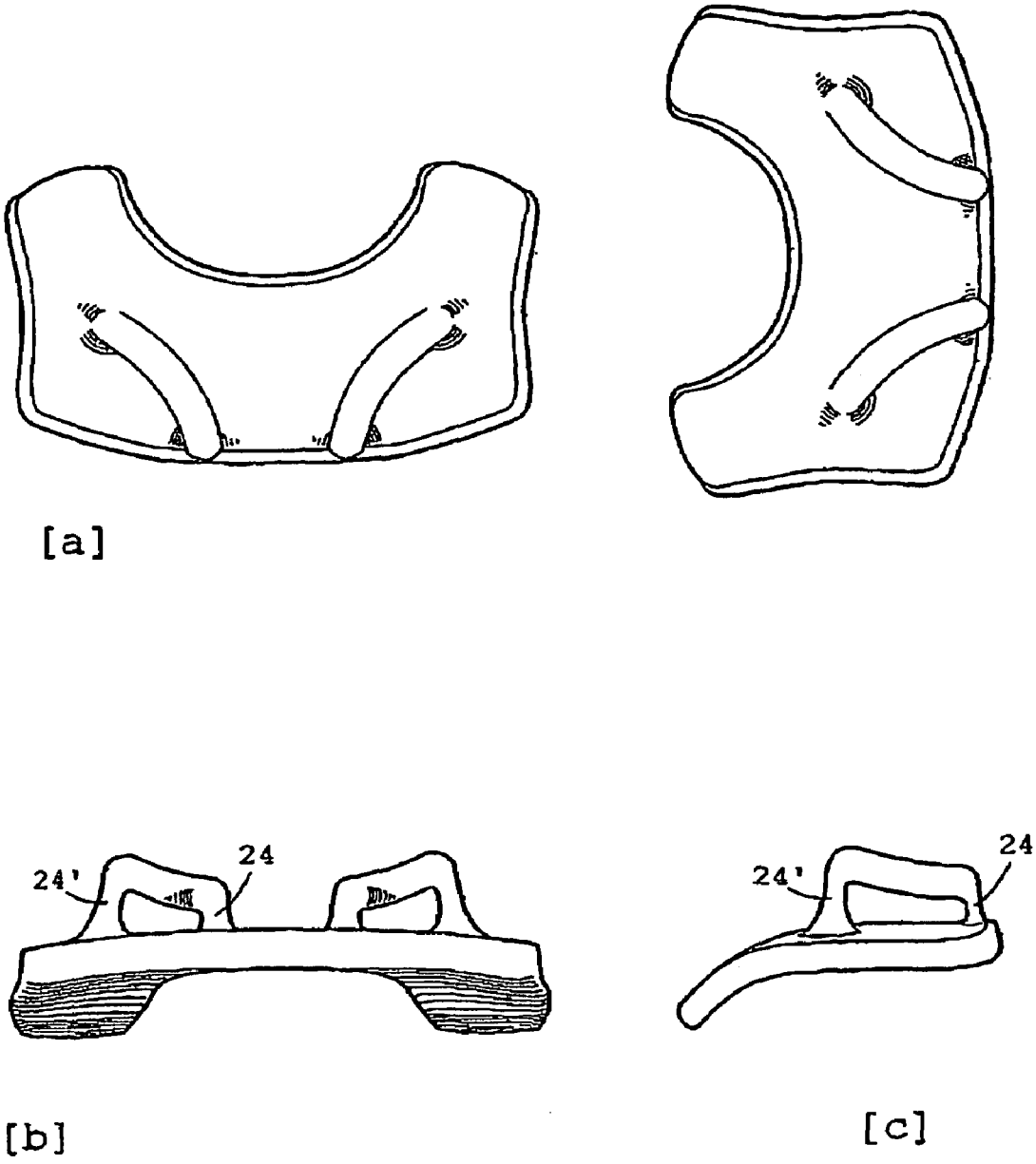

FIG. 3 Embodiment 2.

Figure 4:
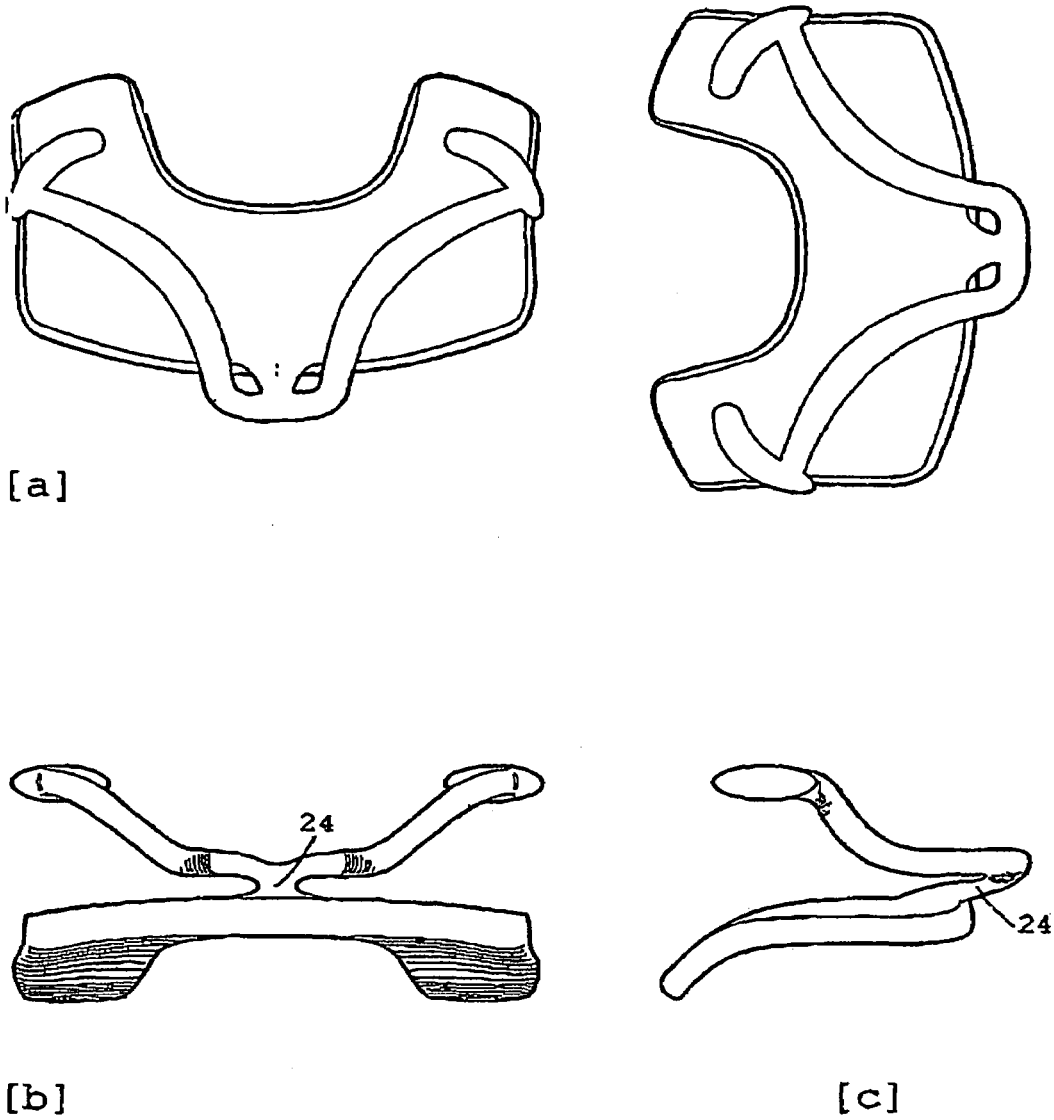

FIG. 4 Embodiment 3.

Figure 5:
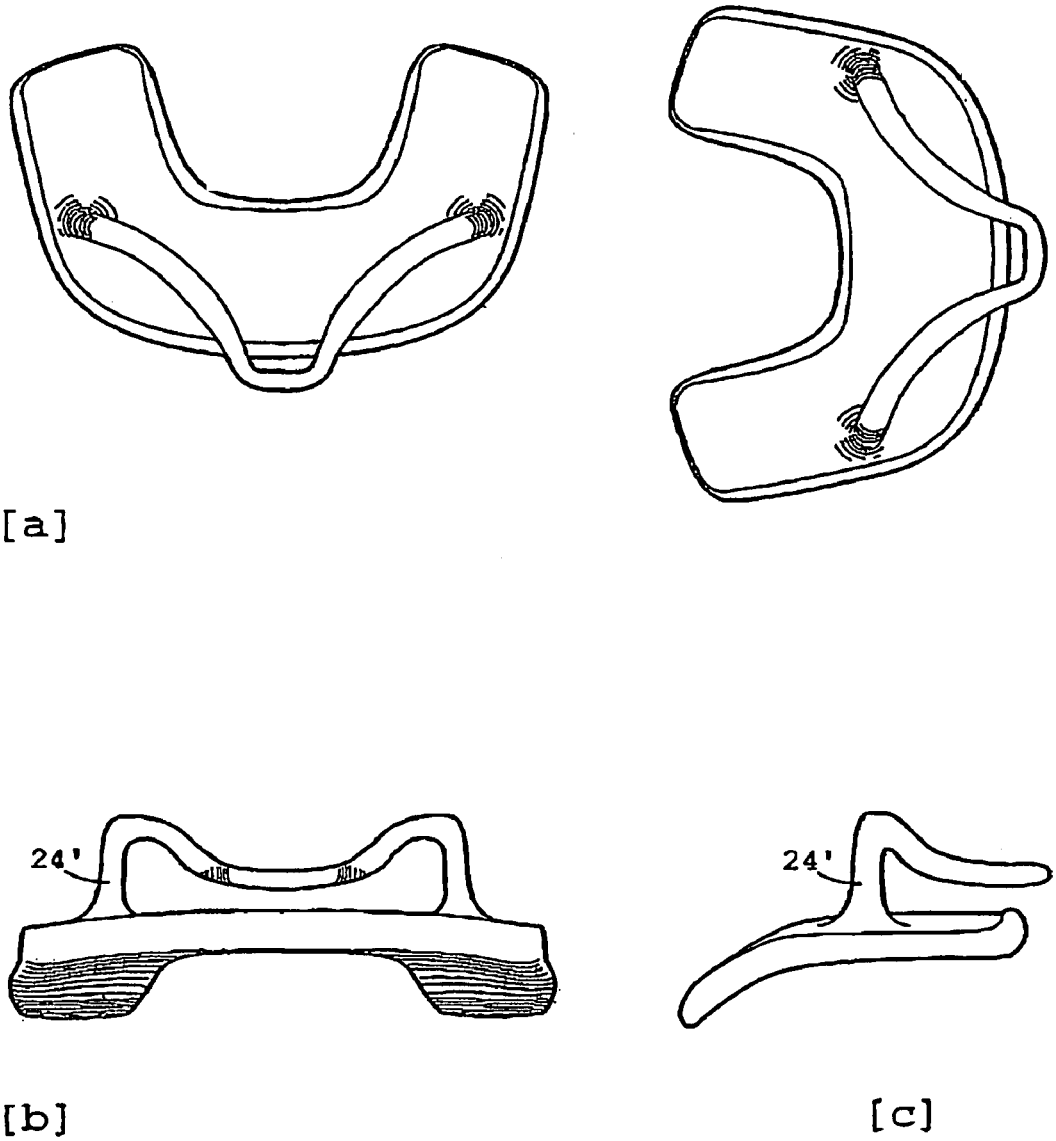

FIG. 5 Embodiment 4.

Figure 6:
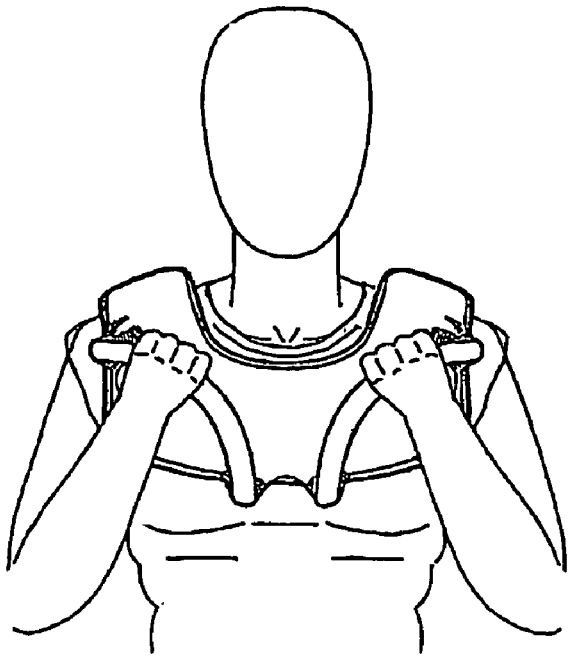
Figure 6:
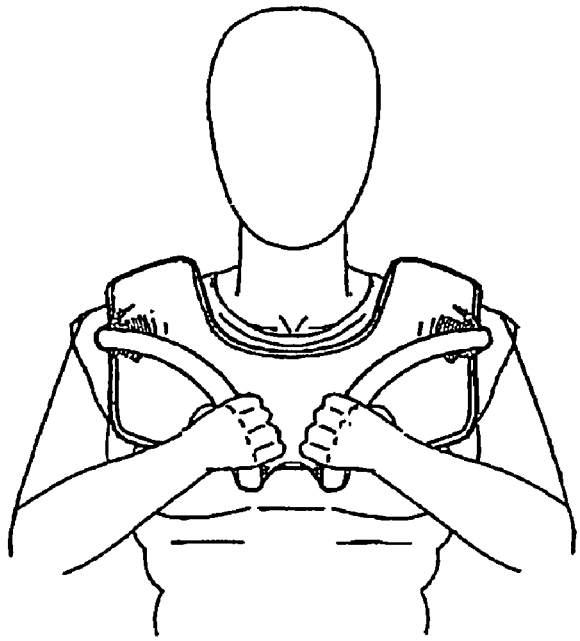

FIG. 6 Gives two examples on how the equipment may be gripped with the hands.

Figure 7:
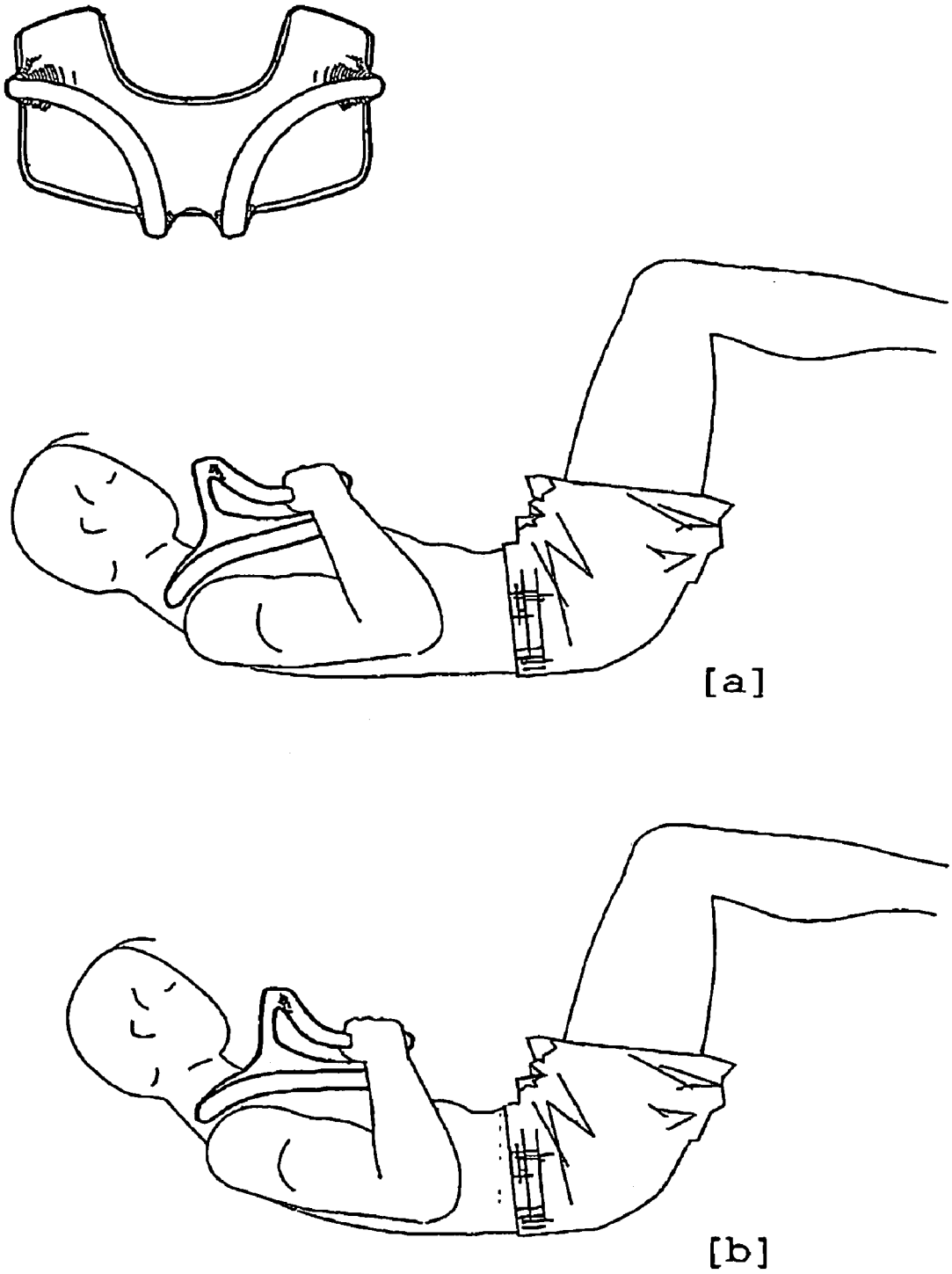

FIG. 7 Gives an example of crunch.

Figure 8:
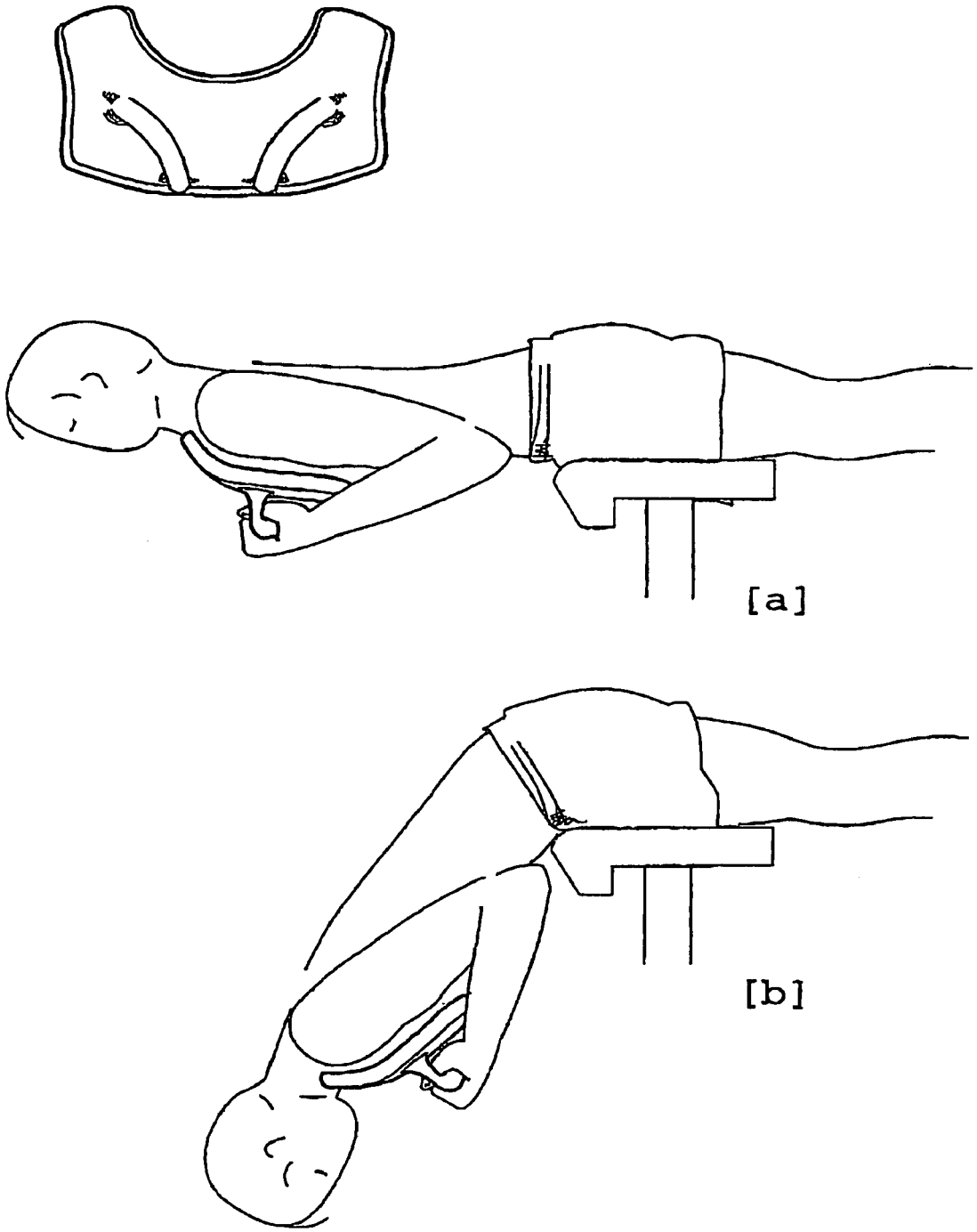

FIG. 8 Gives an example of back extension.

DRAWINGS—NAME OF PARTS

1. Weight plate.
11. Chest part of the weight plate ("chest plate component").
12. Shoulder part of the weight plate ("shoulder plate component").
13. Bottom side.
13'. Bottom side.
14. Edge profile.
U. Recess for the throat.
2. Handle.
21. Low part of handle.
22. Mean height part of handle.
23. High part of handle.
24. Handle fastener.
24'. Handle fastener.

DRAWINGS—MEASUREMENTS

D. Thickness of weight plate.
W. Width of weight plate.
La. Height of shoulder plate.
Lb. Height of chest plate,
Wa. Width of shoulder plate.
h1. Height of handle at breastbone.
h3. Height of handle at armpit.
a. Curvature of shoulder plates.
b1. Angle of handle.
b3. Angle of handle.

DETAILED DESCRIPTION OF THE INVENTION

The invention is a weight equipment consisting of two main components: weight plate (1) and handles (2) A front view of the equipment, and how it is held against the chest when doing training (of crunch, situps, or back extensions), is illustrated in FIG. 1.

The Plate

The weight plate consist of a chest plate component (11) and two shoulder plate components (12), as is shown in FIG. 2*a*. The plate's width (W) is typically 320 mm, and its height (L) is typically 240 mm. The measures may be adapted, and the measures should then be selected such that the chest plate component (11) can rest stably on the upper part of the large chest muscle (pectoralis major), while the shoulder plate components (12) can rest against the region of the front deltoids and the upper trapezium such that a rear surface of the chest plate conforms to a user's chest and forward shoulder body regions without extending rearward beyond a user's upper shoulder.

The Handles

As shown in FIG. 1 the handles makes an arch from a position on the plate in front of the lower part of the breastbone to a position in front of the armpits. This is also illustrated in FIG. 2*a*, where the angle (b1) is small, between 0 and 40 degrees at the upper portion (typically 15 degrees), while the angle (b3) is large, between 40 and 90 degrees at the lower portion (typically in the order of 60-80 degrees). In FIG. 2*b* and FIG. 2*c* the equipment is seen in two lateral views. Observe that the handles' height (above the plate) differs. This is illustrated by the division into height regions (21), (22), and (23) on the handles, where the height (h1) in this embodiment is about 40 mm and the height (h3) is approximately 120 mm. In order to obtain the best possible grip, a smaller value of (h3) should be chosen if the plate is thick compared to if it is thin. The height (h1) on the other hand may be chosen, independent of the plate's thickness, sufficiently large for the hand to be able to grip around the handle.

Other Embodiments

In FIG. 3, FIG. 4, and FIG. 5, three additional embodiments are shown. The display of these embodiments are primarily intended to show, in regard to the fastening of the handles (see (24) and (24')), that neither the number of fastening positions neither their form is essential for achieving the objects of the invention. The invention also encompasses short handles as in FIG. 3, and in this case the handles inclination and height are dependent on where the handles are placed. When placing them high up (close to the shoulders) the handles are inclined relatively much (compare to the above mentioned (b3)) while if the handles are placed low on the plate (in the vicinity of the lower part of the breastbone) they are inclined only a little (compare to the above mentioned (b1)).

Usage

Notice in FIG. 6 the way the equipment can be held with different kind of hand placements. The handles are designed so that the equipment may be held comfortable and stable both in the manner shown in FIG. 6*a* and in FIG. 6*b* and in all positions therebetween. In all cases the wrists can be held straight. A crunch exercise with a low positioned grip is shown in FIG. 7. When doing crunch and situps it may be useful to start the exercise with a high grip but lower it as power drops.

The Bottom Side

The bottom side (13) and (13') of the weight plate consist typically of an approximately 1-2 cm thick padding. The objects of the invention are however also obtained without this padding. The padding's objective is to make the plate more comfortable against the chest, which is helpful if the user only wears a thin T-shirt. The bottom side surface material should have high friction against both textile and metal. The surface material may be rubber or a rubber like material. The surface may also be grooved in order to rest steadily on the upper part of the chest during situps.

The Edges

The edges are typically equipped with a rubber edge profile. An edge profile is however not needed to obtain a good function of the invention. Edges of rubber, elastic, or other shock absorbing material increases security when handling the equipment before and after the exercise. The bottom side and the rubber edge may also be fabricated or joined as one unit.

Material, Plate

The plate is typically made out of cast iron in different plate thicknesses (D). The equipment may for example be fabricated in a collection of 2 kg, 3 kg, 4 kg, 5 kg, 7 kg, 10 kg, and 15 kg, which in case of cast iron corresponds to plate thicknesses from about 4 mm up to approximately 30 mm.

Center of Gravity

The weight of the plate does not have to be evenly distributed over the entire plate, but can for example be concentrated at the shoulder plates. A high placement of the plate's center of gravity makes more effective use of the total weight of the plate, compared to a low placement.

Material, Handles

The handles may be cast in one unit with the plate, or they may be fabricated separately. The handles may be provided with a rubber coating, or a rubber or a plastic covering.

Surface Treatment

The surface of the plate and especially the handles are treated such that they are easy to clean with a towel (especially in order to easily wipe off sweat after use).

The invention claimed is:

1. Weight equipment comprising:

a weighted chest plate; and a handle portion extending from the chest plate for gripping by a user;

wherein the chest plate is shaped and configured to extend over the front upper part of a user's body, the chest plate having left and right chest portions, and left and right shoulder portions which do not extend rearward beyond a user's upper shoulder;

wherein a rear surface of the chest plate is shaped and configured to conform to a user's chest and forward shoulder body regions;

wherein the handle portion comprises left and right handles;

wherein said left and right handles each have lower and upper ends, and the lower and upper ends are fixedly attached to the chest plate.

2. Weight equipment according to claim 1, wherein the handles, viewed from an upright front perspective, are curved in a downwardly and transversely concave shape such that the slope of each handle is greater at a lower portion of the handles than at an upper portion of the handles.

3. Weight equipment according to claim 2, wherein the slope of the handles measured from a horizontal plane is between 40 and 90 degrees at the lower portion, and between 0 and 40 degrees at the upper portion.

4. Weight equipment according to claim 1, wherein a rear surface of the chest plate is padded with a soft material.

5. Weight equipment according to claim 1, wherein peripheral edges of the chest plate are covered by an elastic material.

6. Weight equipment according to claim 1, wherein the weight of the chest plate is more concentrated in the shoulder portions than in the chest portions.

7. Weight equipment comprising:

a weighted chest plate; and a handle portion extending from the chest plate for gripping by a user;

wherein the chest plate is shaped and configured to extend over the front upper part of a user's body, the chest plate having left and right chest portions, and left and right shoulder portions which do not extend rearward beyond a user's upper shoulder;

wherein a rear surface of the chest plate is shaped and configured to conform to a user's chest and forward shoulder body regions.

8. Weight equipment according to claim 7, wherein a rear surface of the chest plate is padded with a soft material.

9. Weight equipment according to claim 7, wherein peripheral edges of the chest plate are covered by an elastic material.

10. Weight equipment according to claim 7, wherein the weight of the chest plate is more concentrated in the shoulder portions than in the chest portions.

11. Weight equipment comprising:

a weighted chest plate; and a handle portion extending from the chest plate for gripping by a user;

wherein the chest plate is shaped and configured to extend over the front upper part of a user's body, the chest plate having left and right chest portions, and left and right shoulder portions which do not extend rearward beyond a user's upper shoulder;

wherein a rear surface of the chest plate is shaped and configured to conform to a user's chest and forward shoulder body regions;

wherein the handle portion comprises left and right handles;

wherein said left and right handles each extend generally parallel to a front surface of the chest plate, in a diagonal upward and transverse direction from a lower part of the chest plate;

wherein the distance between a middle region of each handle and a rear surface of the chest plate is less than the distance between upper and lower ends of each handle and the rear surface of the chest plate.

12. Weight equipment according to claim 11, wherein a rear surface of the chest plate is padded with a soft material.

13. Weight equipment according to claim 11, wherein peripheral edges of the chest plate are covered by an elastic material.

14. Weight equipment according to claim 11, wherein the weight of the chest plate is more concentrated in the shoulder portions than in the chest portions.

* * * * *